US008129962B2

(12) United States Patent
Xie et al.

(10) Patent No.: US 8,129,962 B2
(45) Date of Patent: Mar. 6, 2012

(54) LOW DROPOUT VOLTAGE REGULATOR WITH CLAMPING

(75) Inventors: Yong Xie, Plano, TX (US); Gregory G. Romas, Jr., McKinney, TX (US)

(73) Assignee: Texas Instruments Incorporated, Dallas, TX (US)

( * ) Notice: Subject to any disclaimer, the term of this patent is extended or adjusted under 35 U.S.C. 154(b) by 657 days.

(21) Appl. No.: 12/192,482

(22) Filed: Aug. 15, 2008

(65) Prior Publication Data

US 2010/0039082 A1 Feb. 18, 2010

(51) Int. Cl.
*G05F 1/00* (2006.01)

(52) U.S. Cl. ..... 323/269; 323/271; 323/272

(58) Field of Classification Search ..... 323/273, 323/274, 269, 271, 272, 280, 281
See application file for complete search history.

(56) References Cited

U.S. PATENT DOCUMENTS

| | | | | |
|---|---|---|---|---|
| 6,690,147 | B2 * | 2/2004 | Bonto | 323/280 |
| 6,710,585 | B2 * | 3/2004 | Schmitt et al. | 323/281 |
| 6,977,490 | B1 * | 12/2005 | Zhang et al. | 323/280 |
| 7,230,408 | B1 * | 6/2007 | Vinn et al. | 323/273 |
| 7,602,161 | B2 * | 10/2009 | McLeod | 323/273 |
| 2003/0184268 | A1 * | 10/2003 | Perez et al. | 323/282 |

* cited by examiner

*Primary Examiner* — Jeffrey Sterrett
*Assistant Examiner* — Lakaisha Jackson
(74) *Attorney, Agent, or Firm* — William B. Kempler; Wade J. Brady, III; Frederick J. Telecky, Jr.

(57) ABSTRACT

Apparatus and methods for reducing output load transients of a low dropout voltage regulator ("LDO") are disclosed herein. A voltage regulator includes an output driver coupled to a regulator output pin, the output driver provides current to a load external to the regulator. A clamping device is coupled between the output pin and an internal node of the regulator. The clamping device forces a voltage at a control input of the output driver to follow the voltage at the output pin when the output driver is disabled.

17 Claims, 2 Drawing Sheets

LOW DROPOUT VOLTAGE REGULATOR WITH CLAMPING

BACKGROUND

Many battery-powered devices such as, for example, mobile phones or electronic notebooks contain complex integrated circuits powered by one or more supply voltages. These supply voltages are often generated from a battery voltage by voltage regulators integrated in semiconductor circuits. One type of linear voltage regulator is the low drop out voltage regulator ("LDO"). An LDO is capable of furnishing a stable regulated voltage even when the difference between the battery voltage and the desired supply voltage is very small. Consequently, the battery voltage may be only insignificantly higher than the desired output voltage and as a rule the dissipation loss of the LDO is very low. Thus, the LDO is capable of stabilizing the supply voltage even when the battery voltage has been greatly reduced due to discharge.

The various circuits to which an LDO supplies voltage may have several different operational modes, with each mode presenting a different load to the regulator. As the circuit changes modes, the load presented to the regulator can rapidly change. Rapid load changes can result in generation of transients at the regulator output. Generally, power supply voltage transients are to be avoided. Consequently, improved LDO load transient response is desirable.

SUMMARY

Accordingly, various techniques for improving load transient response of a low dropout regulator ("LDO") are herein disclosed. In accordance with at least some embodiments, a voltage regulator includes an output driver. The output driver is coupled to a regulator output pin, and provides current to a load external to the regulator. A clamping device is coupled between the output pin and an internal node of the regulator. The clamping device causes a voltage at a control input of the output driver to follow the voltage at the output pin when the output driver is disabled.

In other embodiments, a method includes clamping a control input of an LDO output driver to an LDO output pin voltage.

In other embodiments, an LDO comprises means for clamping a control input of an LDO output driver to an output pin voltage of the LDO.

BRIEF DESCRIPTION OF THE DRAWINGS

For a detailed description of exemplary embodiments of the invention, reference will now be made to the accompanying drawings in which.

NOTATION AND NOMENCLATURE

Certain terms are used throughout the following description and claims to refer to particular system components. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct electrical connection. Thus, if a first device couples to a second device, that connection may be through a direct electrical connection, or through an indirect electrical connection via other devices and connections.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Various industries, the automotive industry for example, have increasingly demanded low drop out voltage regulators ("LDOs") with fast transient response. In LDO applications, N-Channel Metal Oxide Semiconductor ("NMOS") outputs are more popular than P-Channel MOS ("PMOS") outputs because the transistor size is smaller and the compensation scheme is simpler. However, because the internal nodes of an NMOS output LDO experience a large voltage swing when the output transistor transitions from off to on state, the load transient response of the NMOS output LDO can be problematic when a system needs to switch loads within a short time interval. Embodiments of the present disclosure provide improved load transient response by clamping various internal nodes of an NMOS LDO to the LDO output voltage.

Figure 1:
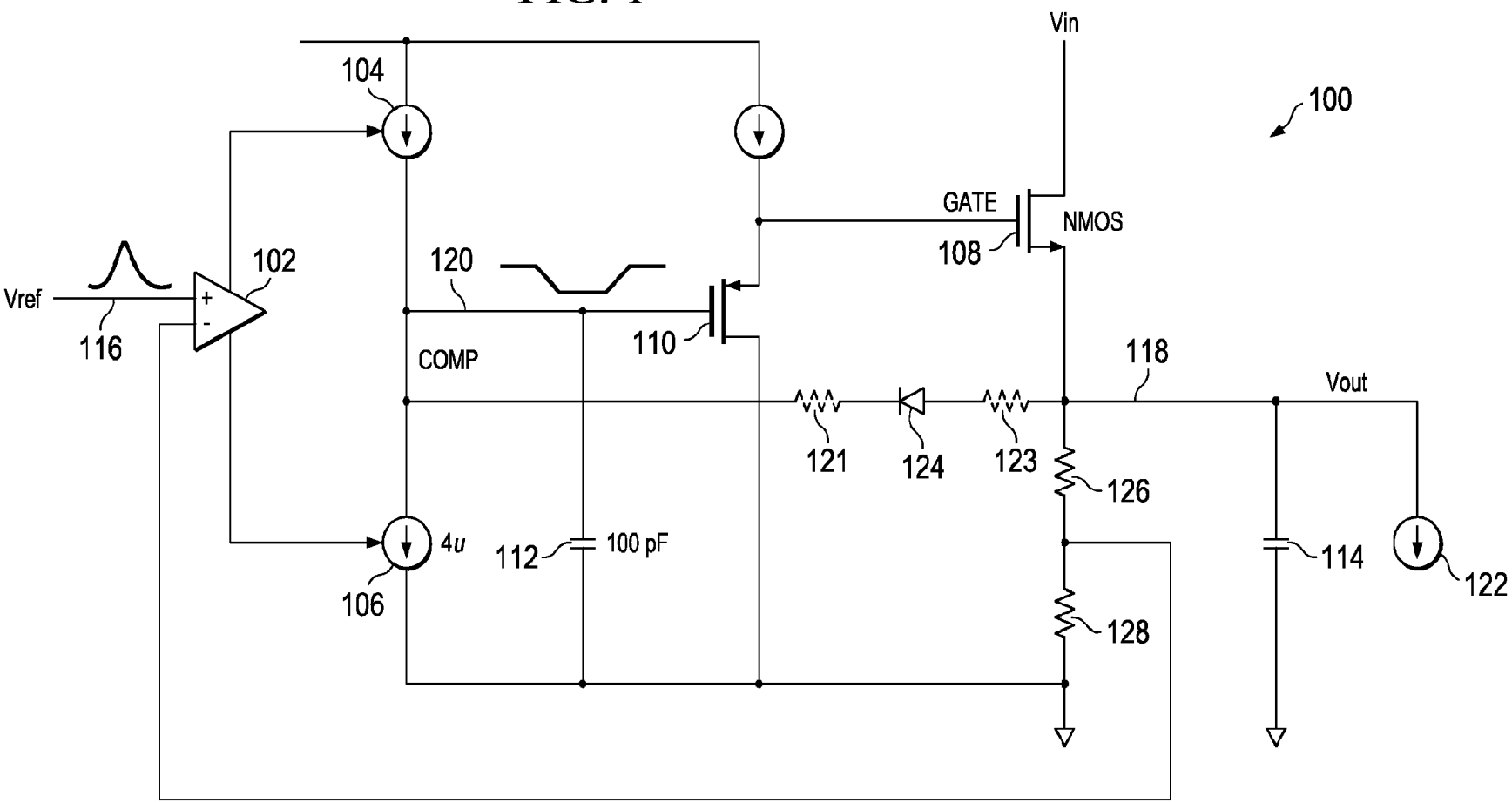
FIG. 1 shows an illustrative diagram of a low drop out voltage regulator ("LDO") including compensation node clamping in accordance with various embodiments.

FIG. 1 shows an illustrative circuit diagram of an NMOS output LDO 100. The LDO 100 includes a differential input stage 102. Inputs to the differential input stage 102 include a reference voltage ("VREF") 116, and the output voltage 118 scaled by a voltage divider comprising resistors 126, 128. The differential input stage 102 controls two current sources 104, 106 that in turn control the NMOS output driver 108 through a PMOS source follower 110.

A compensation capacitor 112 establishes an internal pole that ensures the circuit gain drops sufficiently before poles other than the internal and output poles become effective. The compensation capacitor 112 may have a capacitance of, for example, 100 pico-farads, but embodiments are not limited to any particular value of capacitance. As load current decreases, the external pole formed by capacitor 114 and the equivalent resistance at the output node may become dominant. However, the LDO 100 control loop should see at most 2 poles, or 180 degree phase shift, before the loop gain drops below unity. Thus, stability is guaranteed.

If for some reason the VREF 116 provided to differential input stage 102 momentarily increases, the output voltage 118 will also increase. After the VREF 116 glitch subsides, the output 118 should decrease accordingly. To effect the decrease in output 118 voltage the NMOS output transistor 108 is turned off. Because the output capacitor 114 is typically large, the time required to discharge the capacitor 114 may be excessively long. The voltage on the internal compensation node 120 will drop during this discharge period until it reaches a ground level. If the current required by the external load 122 increases during the discharge period (i.e., after partial or complete discharge of capacitor 112), the compensation capacitor 112 must be recharged before the gate of the output transistor 108 is driven high enough to cause the NMOS transistor 108 to drive the output 118. If the compensation node 120 has discharged to ground level, the compensation node 120 may need to transition several volts to reach $V_{out}$ level, resulting in a substantial time delay from presentation of a requirement for increased current and supply of the required current by the NMOS output transistor 108. As described, the delay is a result of the time required to charge the relatively large compensation capacitor 112 from a low current source 104. The slew time can be tens of microseconds, during which time the load current is supplied only by the output capacitor 114 causing the output voltage to drop (i.e., causing an output transient). The duration of the output voltage transient is therefore dependent on the voltage level of the gate of the NMOS output transistor 108 when an increased load is presented and the amount of current the load 122 requires from the output 118. The described output voltage transient can cause a variety of undesirable consequences in the load. For example, a low voltage error can occur if the output voltage drops too low and/or a system reset can be triggered which may cause a system failure.

Some LDO embodiments employ a PMOS output transistor to mitigate the above described output voltage transient. However, PMOS transistors are substantially larger in physical size than NMOS transistors of similar output capability. Moreover, such embodiments generally have more gain and the output pole is usually located at a lower frequency, thus they are more difficult to compensate.

Other LDO embodiments may use an NMOS output transistor and employ a PMOS load transistor to discharge the output capacitor 114 if the compensation node 120 voltage drops too low. In such an embodiment, the gate of the PMOS load transistor is coupled to the compensation node 120. When compensation node 120 voltage falls one $V_{gs}$ below the output, the PMOS load transistor is turned on and discharges the output 118 so the LDO can go back into regulation faster. If, however, the PMOS transistor is not large enough, a large $V_{gs}$ is needed to enable the PMOS transistor to discharge the output capacitor 114, thus, the compensation node 120 voltage can still drop substantially before the output capacitor 114 is discharged. Thus, a significant improvement may require a large PMOS load transistor.

Embodiments of the present disclosure provide improved load transient response while advantageously employing an NMOS output transistor 108 and omitting a PMOS load transistor. As shown in FIG. 1, embodiments include a clamping diode 124. The clamping diode 124 provides improved load transient response by limiting the compensation node 120 voltage from falling more than one $V_{be}$ (i.e., one diode drop) below the output 118 voltage. When, as described above, the differential input stage 102 attempts to reduce the voltage at output 118, the compensation node 120 voltage will begin to drop. In embodiments of the present disclosure, when the compensation node 120 voltage drops sufficiently to forward bias the clamping diode 124, current flowing through the diode 124 will hold the compensation node 120, and consequently hold the NMOS output transistor 108 gate, at approximately the output 118 voltage. The diode 124 can be relatively small because only a small amount of current (e.g., microamps) is needed to keep the compensation node 120 voltage from falling. Thus, the gate of the NMOS output transistor 108 is clamped at approximately the output voltage. No current flows through the diode 124 before the NMOS output transistor 108 turns off, so the diode 124 has no effect in normal operation. Because embodiments of the present disclosure hold the NMOS output transistor 108 gate voltage at approximately the LDO 100 output voltage, one $V_{gs}$ level transition in the compensation node 120 can turn on the NMOS output transistor 108. Embodiments without the diode 124 must swing from ground to $V_{out}$ to turn on the NMOS output transistor. Thus, embodiments of the present disclosure reduce the amplitude and duration of LDO 100 output load transients by reducing the NMOS output transistor 108 gate voltage swing required to enable the transistor 108, and consequently the time required to enable the transistor 108.

Some embodiments include an optional resistor 123 coupled between the output 118 and the diode 124, or an optional resistor 121 between the diode 124 and the compensation node 120 to limit current flowing from the output 118 to the compensation node 120 through the diode 124. The resistor reduces the risk of electrostatic discharge ("ESD") damage to the internal nodes of the LDO 100. A resistor in the range of, for example, tens of kilo-ohms introduces no significant voltage drop because only micro-amperes of current flow through the diode 124 during clamping.

Figure 2A:
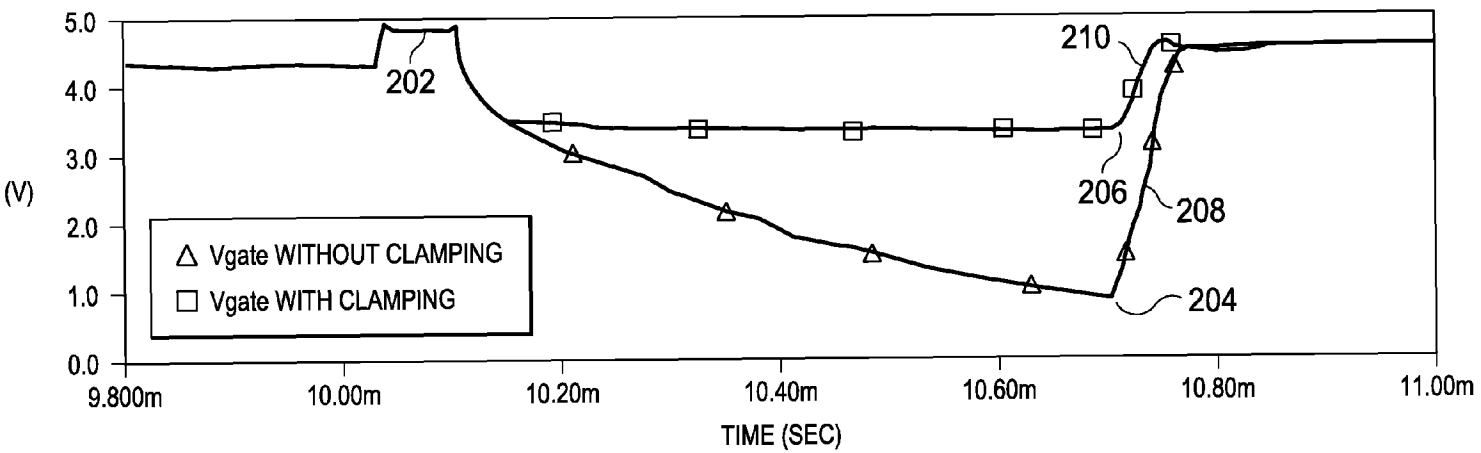
FIGS. 2A and 2B show a performance simulation of an LDO including compensation node clamping in accordance with various embodiments.

FIG. 2A shows a simulation of the voltage levels at the gate of the NMOS output transistor 108 of embodiments with and without the clamping diode 124 to restrict the voltage level of compensation node 120. A heavy load is applied to the LDOs and the NMOS output transistor 108 gate voltage increases to about 4.8V in response at 202. When the load is reduced, the gate voltage of the embodiment without the clamping diode 124 falls to approximately 1 volt within approximately 600 us. In contrast, in the embodiment with the clamping diode 124, current flowing from the output 118 through the diode 124 to the compensation node 120 limits the gate to about 3.4 volts at 206. Consequently, when the load is increased, the embodiment without diode clamping requires about 60 us to transition 208 to operable voltage while the embodiment with diode clamping transitions in approximately 25 us 210.

Figure 2B:
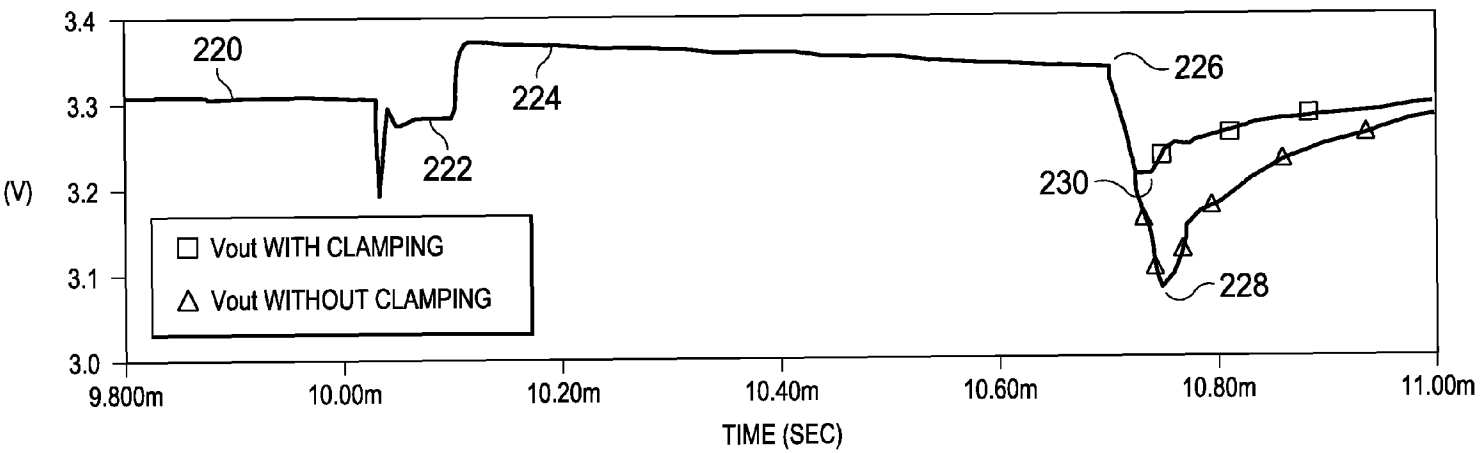

FIG. 2B corresponds to FIG. 2A and shows a simulation of the output voltage of NMOS output LDO embodiments with and without the clamping diode 124 to restrict the voltage level of compensation node 120. The output voltage of both LDOs is nominally 3.3 volts 220. The output is heavily loaded at 222 and lightly loaded at 224. While lightly loaded the output transistor 108 is turned off. The gate voltage of the unclamped LDO NMOS output transistor drops to about 1V as shown in FIG. 2A while the gate voltage of the clamped LDO of the present disclosure drops to only about 3.4 V. When the load on the output is increased at 226, the output of the unclamped LDO drops about 220 milli-volts ("mv") below the nominal output voltage at 228. The clamped LDO of the present disclosure drops only about 90 mv, at 230, below the nominal output voltage. Transient response performance improvement provided by embodiments of the present disclosure become even more significant as the load applied at 226 increases.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A voltage regulator, comprising:

an output driver coupled to a regulator output pin, the output driver provides current to a load external to the regulator;

a clamping device coupled between the output pin and an internal node of the regulator;

wherein the clamping device forces a first voltage at a control input of the output driver to follow a second voltage at the output pin when the output driver is disabled, wherein the clamping device prevents a third voltage at a compensation node from falling lower than approximately one Vbe (base-emitter voltage) below the second voltage at the regulator output pin and wherein the first voltage at the control input of the output driver follows the third voltage at the compensation node.

2. The voltage regulator of claim 1, wherein the internal node is a compensation node.

3. The voltage regulator of claim 2, further comprising a capacitor coupled to the compensation node and wherein the clamping device charges the capacitor when the output driver is disabled.

4. The voltage regulator of claim 1, wherein the clamping device allows current to flow from the regulator output pin to the internal node.

5. The voltage regulator of claim 1, wherein the clamping device is a diode.

6. The voltage regulator of claim 1, wherein the output driver comprises an N-Channel Metal Oxide Semiconductor ("N-MOS") Field Effect Transistor ("FET") and the control input comprises the gate terminal.

7. The voltage regulator of claim 1, further comprising a current limiting device coupled to the clamping device to limit the current flowing from the regulator output pin to the internal node.

8. The voltage regulator of claim 7, wherein the current limiting device comprises a resistor.

9. The voltage regulator of claim 1 wherein the regulator is a low-dropout regulator (LDO).

10. A method for reducing transient response time, comprising:

clamping a control input of a low dropout voltage regulator ("LDO") output driver to an LDO output pin voltage; and inhibiting an internal compensation node voltage from falling more than one diode drop below the output pin voltage.

11. The method of claim 10, further comprising clamping an internal compensation node of the LDO to the LDO output pin voltage.

12. The method of claim 10, further comprising driving the control input based on the voltage at the clamped internal compensation node.

13. The method of claim 10, further comprising limiting the current flowing from the output pin to the compensation node.

14. The method of claim 10, further comprising charging an internal compensation capacitor with current flowing from the LDO output when the output driver is disabled.

15. A low drop out voltage regulator ("LDO"), comprising:

an output driver that provides current to a load external to the regulator; and means for clamping a control input of the output driver to an output pin voltage of the LDO; and means for inhibiting an internal compensation node voltage from falling more than one diode drop below the output pin voltage.

16. The LDO of claim 15, further comprising means for clamping an internal compensation node of the LDO to the output pin voltage of the LDO.

17. The LDO of claim 15, further comprising means for limiting the current flowing from the output pin to the compensation node.

* * * * *